US006543270B2

(12) United States Patent
Cmelik

(10) Patent No.: US 6,543,270 B2
(45) Date of Patent: Apr. 8, 2003

(54) AUTO BODY DENT REPAIR TOOL

(76) Inventor: Mike J Cmelik, 5030 Upper Hayden Lk Rd., Hayden Lk, ID (US) 83835

( * ) Notice: Subject to any disclaimer, the term of this patent is extended or adjusted under 35 U.S.C. 154(b) by 0 days.

(21) Appl. No.: 09/727,351

(22) Filed: Dec. 1, 2000

(65) Prior Publication Data

US 2002/0066301 A1 Jun. 6, 2002

(51) Int. Cl.[7] ..... B21J 13/02

(52) U.S. Cl. ..... 72/478; 72/479; 72/481.8; 72/482.1; 72/705

(58) Field of Search ..... 72/465.1, 466, 72/477, 478, 479, 480, 481.1, 481.3, 481.8, 705, 482.1, 482.3, 482.93; 81/177.7, 177.8

(56) References Cited

U.S. PATENT DOCUMENTS

| | | | | | |
|---|---|---|---|---|---|
| 1,737,084 | A | | 11/1929 | Hilsted | |
| 2,263,247 | A | | 11/1941 | Raisaneu | |
| 2,444,250 | A | | 6/1948 | Ferguson | |
| 2,524,321 | A | * | 10/1950 | LeMasters | 72/478 |
| 2,539,040 | A | * | 1/1951 | Sparhawk | 72/705 |
| 2,795,983 | A | | 6/1957 | Killius | |
| 2,957,376 | A | * | 10/1960 | Parisi | 72/705 |
| 3,091,983 | A | * | 6/1963 | Kliss | 72/705 |
| 3,541,835 | A | | 11/1970 | Hunnicutt | |
| 4,235,090 | A | * | 11/1980 | Wightman et al. | 72/705 |
| 4,461,192 | A | * | 7/1984 | Suligoy et al. | 81/177.7 |
| 4,502,317 | A | * | 3/1985 | Hultquist | 72/705 |
| 4,503,701 | A | | 3/1985 | Hardy | |
| 5,329,802 | A | * | 7/1994 | Nunez | 72/705 |
| 5,461,900 | A | * | 10/1995 | Gutierrez | 72/479 |
| 5,769,395 | A | | 6/1998 | Patti | |
| 6,234,049 | B1 | * | 5/2001 | Ju et al. | 81/177.7 |
| 6,347,564 | B1 | * | 2/2002 | Ciocca | 81/177.8 |
| 6,405,620 | B2 | * | 6/2002 | Liao | 81/177.7 |

* cited by examiner

*Primary Examiner*—Ed Tolan
(74) *Attorney, Agent, or Firm*—David S. Thompson

(57) ABSTRACT

A kit of parts for auto body dent repair includes a plurality of tool bodies (11) and a plurality of tips (80). Each tool body includes a rearward shaft (20) and handle (60). The rearward shafts of the various tool bodies include both those with compound (bent) shafts and simple (straight) shafts. The lengths of the tool bodies varies to fit different needs. Each tool body also includes a forward shaft (40), which is adjustably attached to a forward end of the rearward shaft. The appropriate tip may be installed on the forward end of the forward shaft of the appropriate tool body. As an alternative to the tips (80) and forward shafts (40), an integral dent repair tip (50) provides the functionality of a both in a single unit. In use, the appropriate tip (80), or integral dent repair tip (50), for the job may be installed on the appropriate tool body. The overall tool is then used to remove the dent from an auto body panel by applying force correctly to the inside surface of the body panel.

3 Claims, 5 Drawing Sheets

AUTO BODY DENT REPAIR TOOL

CROSS-REFERENCES

There are no applications related to this application filed in this or any foreign country.

BACKGROUND

The number of auto body dents increases every year with the increase in traffic, and the cost of the repair of each increases annually due to the cost of labor, materials and other factors.

The difficulty in repairing auto body dents is also increasing, due to the complexity found in late model cars. For example, while the inside surfaces of door panels were previously relatively easy to access, the inclusion of power locks, power windows, side air bags, impact-absorbing structures and other equipment has made access to the inside surface more difficult. As a result, known tools are frequently inadequate for the job, and as a result it is often the case that entire panels cannot be repaired and must be replaced.

Additionally, it is frequently the case that a wide variety of prior art tools must be purchased, so that, when needed, a tool of the correct size and shape will be available.

For the foregoing reasons, there is a need for an auto body dent repair tool that can be used to repair a wide variety of dents, in a wide variety of locations, in a wide variety of vehicles with differing option packages, configuration and equipment. The auto body dent repair tool must be easily re-configurable and adjustable to extend into a variety of difficult-to-reach areas. Additionally, the auto body dent repair tool must be adapted for use with a wide variety of interchangeable tips. And further, the auto body dent repair tool must include an articulating shaft, which allows adjustment to conform to the particular needs of any given application.

SUMMARY

The present invention is directed to an apparatus that satisfies the above needs. A novel kit of parts comprising an auto body dent repair tool 10 is disclosed that can be used to repair a wide variety of dents, in a wide variety of locations, in a wide variety of vehicles with differing option packages, configuration and equipment. The auto body dent repair tool is easily re-configurable and adjustable to extend into a variety of difficult-to-reach areas; is adapted for use with a wide variety of interchangeable tips; and further, includes an articulating shaft, which allows adjustment to conform to the particular needs of any given application.

A kit of parts for auto body dent repair, comprises an auto body dent repair tool 10 of the present invention, provides some or all of the following structures.

(A) A plurality of tool bodies, wherein each tool body includes some or all of the following structures.

(a) A rearward shaft 20 may include a compound 21 or simple shaft 25. The compound shaft includes forward and rearward portions 22, 23 separated by a fixed joint 24, while the simple shaft includes no fixed joint. A rear end 26 of the rearward shaft is attached to a handle 60. A forward end 28 carries an adjustable fastener 29, which is attachable to a forward shaft 40 or an integral dent repair tip 50.

(b) A forward shaft 40 may be pivoted to a desired angle with respect to the rearward shaft, and then secured in place. An adjustable fastener 41, carried by a rearward portion of the forward shaft, mates with the similar fastener 29 carried by the rearward shaft. The angle is selected based on the configuration of the auto body panel having a dent to be removed. A tip fastener peg 45 is carried by a forward portion of the forward shaft, and allows attachment of any of a variety of tips 80.

(c) A handle 60 is carried by a rearward portion 23 of the rearward shaft 20. The handle allows the user to firmly grasp the auto body dent repair tool 10 during operation.

(B) A plurality of integral dent repair tips 50, wherein each integral dent repair tip may be installed on the adjustable fastener 29 of the rearward shaft 20 as an alternative to the forward shaft 40 and a tip 80. The integral dent repair tip provides functionality that is similar to that of the forward shaft 40 and tip 80.

(C) A plurality of tips 80, wherein any of a plurality of tips may be attached to the tip fastener peg 45 of the forward shaft 40. The tip attached at any given time is selected after reflection on the size, shape and nature of the dent and the nature of the access to the dent. In a preferred embodiment of the kit of parts the tips include: a cylinder with half-sphere end, a small, mid-sized and large cylinders with rounded end, a cylinder with conical end, and small, mid-sized and large spheres.

It is therefore a primary advantage of the present invention to provide a kit of parts comprising a novel auto body dent repair tool, wherein the kit of parts can be adapted and adjusted for use in repairing a wide variety of dents, in a wide variety of locations, in a wide variety of vehicles with differing option packages, configuration and equipment.

Another advantage of the present invention is to provide a kit of parts comprising a novel auto body dent repair tool that may be configured in many ways, and is therefore more efficient and cost effective than conventional dent repair tools.

A still further advantage of the present invention is to provide a kit of parts comprising a novel auto body dent repair tool, which provides a rearward compound shaft in combination with an adjustable forward shaft, and thereby results in greater flexibility and more convenient use.

Other objectives, advantages and novel features of the invention will become apparent to those skilled in the art upon examination of the specification and the accompanying drawings.

DRAWINGS

These and other features, aspects, and advantages of the present invention will become better understood with regard to the following description, appended claims, and accompanying drawings where:

DESCRIPTION

Figure 1:
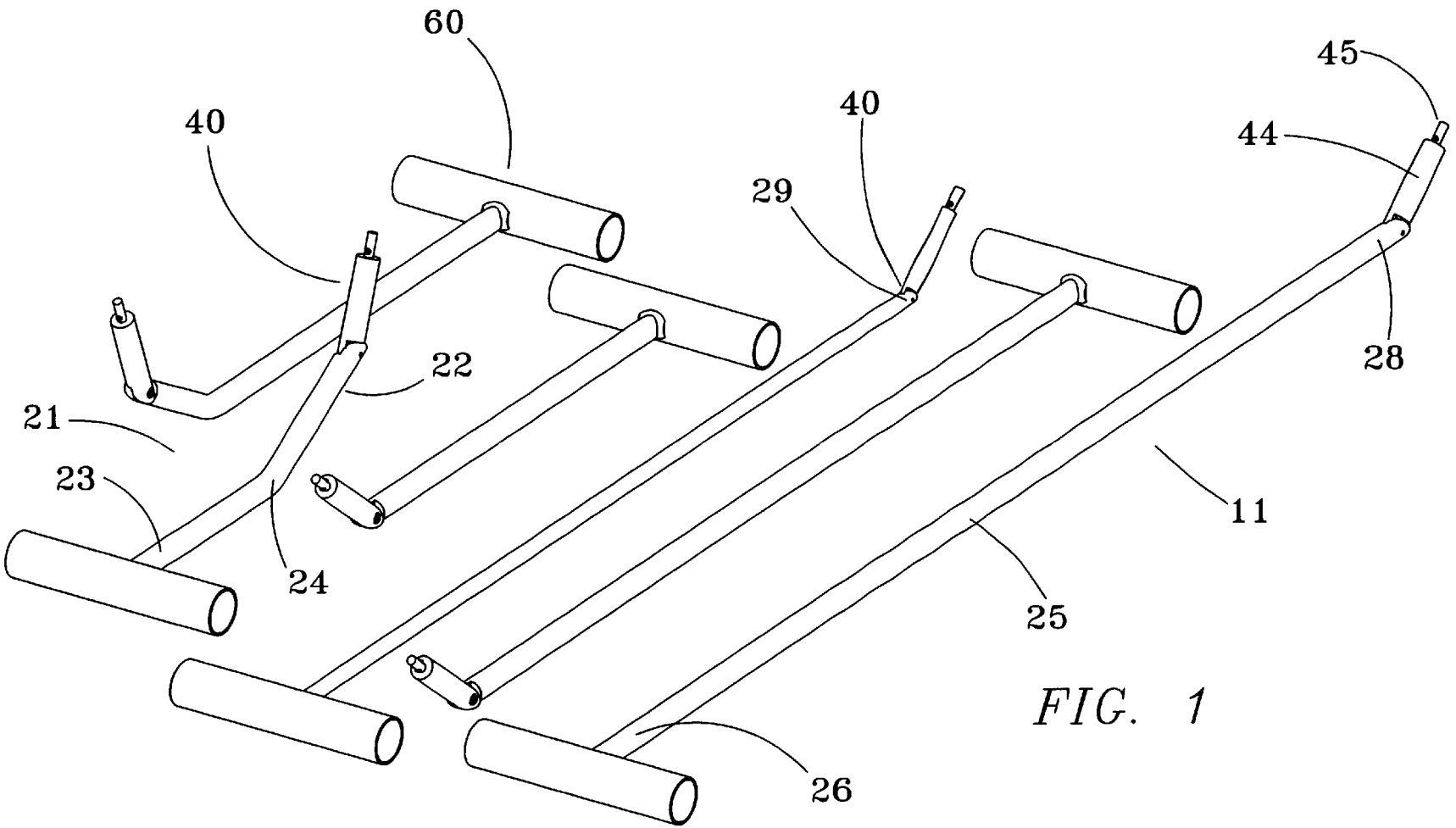
FIG. 1 is a perspective view of the kit of parts for auto body dent repair, having the tips removed.
Figure 2:
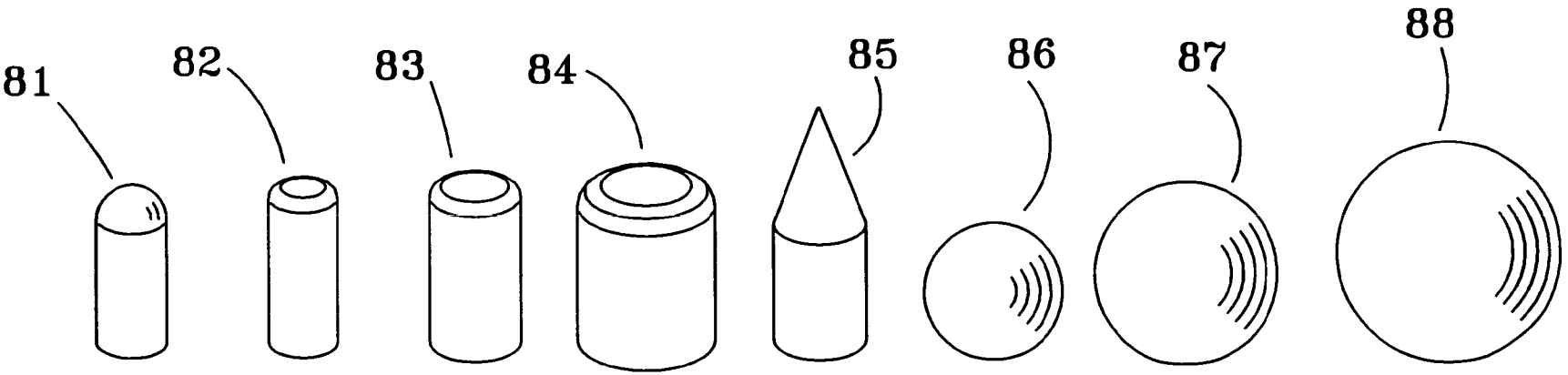
FIG. 2 is a perspective view of the tips present in the kit of parts for auto body dent repair.
Figure 9:
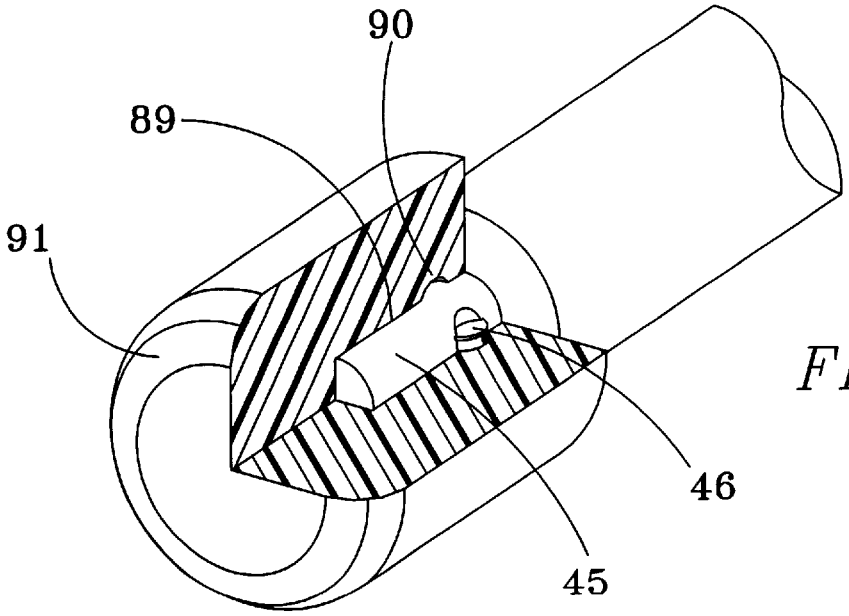
FIG. 9 is a partial cross-sectional view of a tip, illustrating the connection to the tip fastener peg of the forward shaft.

Referring in generally to FIGS. 1, 2 and 9, a kit of parts for formation of a plurality an adjustable auto body dent repair tool 10, constructed in accordance with the principles of the invention, is seen. The preferred kit of parts includes a plurality of tool bodies 11, as seen in FIG. 1 and a plurality of tips 80, as seen in FIG. 2. Each tool body includes a rearward shaft 20 and handle 60. The rearward shafts of the various tool bodies include both those with compound (bent) shafts and simple (straight) shafts. The lengths of the tool bodies varies to fit different needs. Each tool body is adjustably connected to a forward shaft 40 in a manner, which allows adjustment of the angle between the forward end of the tool body and the forward shaft. The appropriate tip may be installed on the forward end of the forward shaft carried by the tool body. As an alternative to the tips 80 and forward shafts 40, an integral dent repair tip 50 provides the functionality of a both in a single unit. In use, the appropriate tip 80, or integral dent repair tip 50, for the job may be installed on the appropriate tool body. The overall tool is then used to remove the dent from an auto body panel by applying force correctly to the inside surface of the body panel.

In a preferred embodiment of the invention, the handle 60, rearward shaft 20 forward shaft 40 and integral dent repair tip 50 are all made of heat-treated stainless steel. While other materials could be substituted, the results during use would generally be less effective.

Referring particularly to FIG. 1, it can be seen that the tool body 11 includes a rearward shaft 20. The rearward shaft may include a compound 21 or simple shaft 25. The compound shaft includes forward and rearward portions 22, 23 separated by a fixed joint or elbow 24. The elbow typically has an inside measurement of 30 to 45 degrees, but could be varied somewhat according to the needs of any given application. Due to the angle of the elbow 24, the compound shaft is suited for use in some tightly constrained locations where a straight shaft would not pass.

In the preferred embodiment of FIG. 1, the rearward shaft may be made of ⅜" or ½" heat-treated stainless steel rod with a circular cross-section. Where a compound shaft is present, a first preferred tool body has a 4" forward portion 22 and a 16" rearward portion 23. A second preferred tool body has a 5" forward portion and a 10.5" rearward portion. Each preferred version of the tool body may be constructed with diameters of either a ⅜" or ½".

The simple shaft includes no fixed joint, and is therefore a straight shaft. The straight shaft is advantageous in certain applications having sufficient clearance for the shaft to pass. As seen in FIG. 1, third through sixth preferred versions of the tool body include simple shaft include lengths of 13", 25" and 32", with diameters of either a ⅜" or ½".

Figure 6:
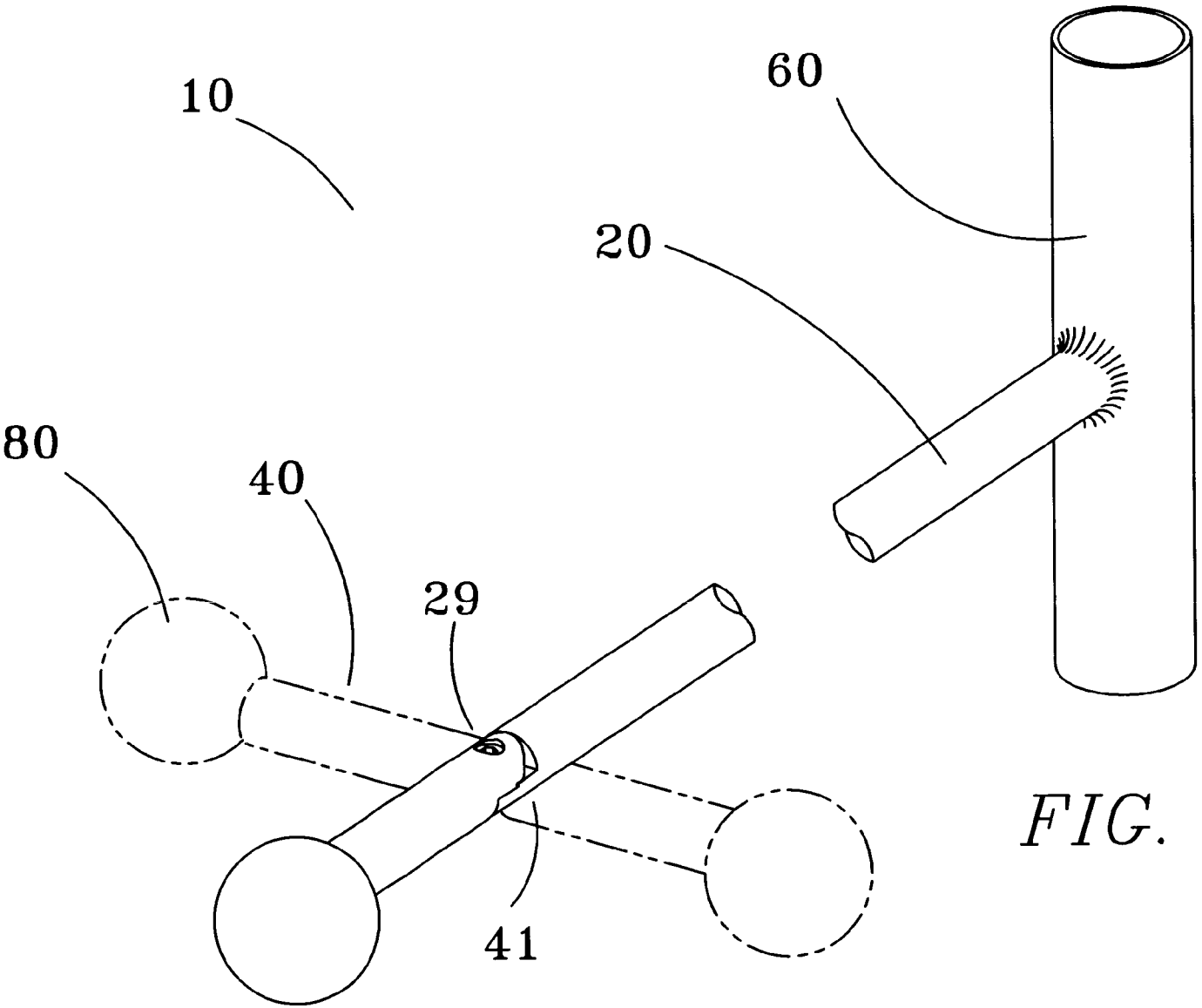
FIG. 6 is a perspective view, illustrating how the forward shaft may be adjusted relative to the rearward shaft.
Figure 7:
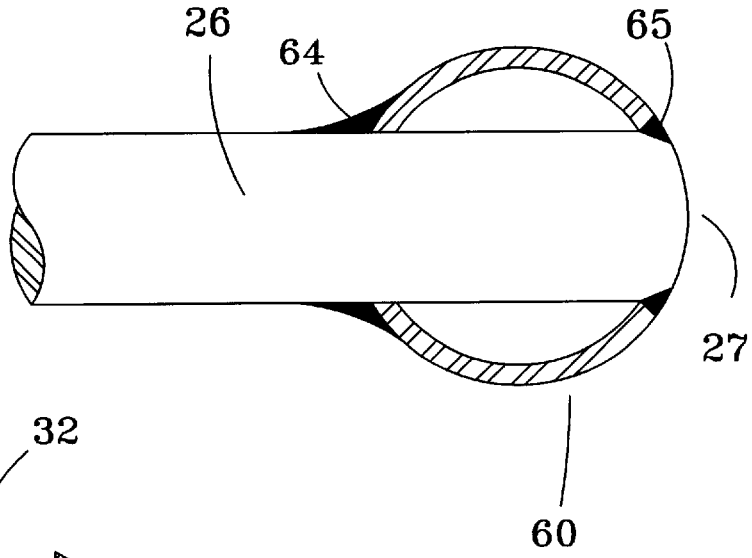
FIG. 7 is a side cross-sectional view, showing the nature of the connection between the rearward portion of the rearward shaft and the handle.

A rear end 26 of the rearward shaft 20 is attached to a handle 60. Referring particularly to FIGS. 6 and 7, it can be seen that the rear end 26 of the shaft passes through forward and rearward holes 62, 63 defined in the handle 60. The end surface 27 of the rear end of the shaft is rounded to match the diameter of the handle.

Figure 8:
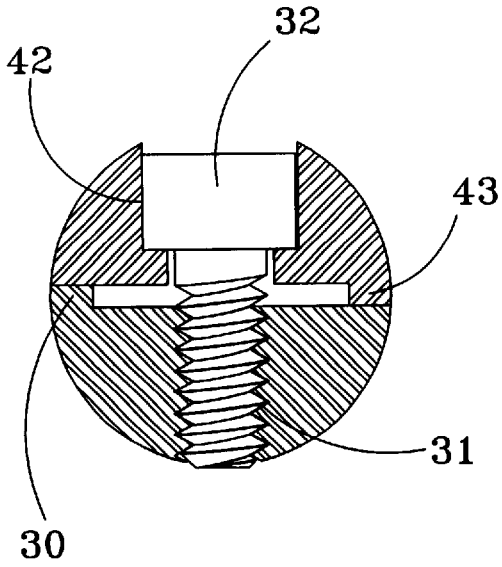
FIG. 8 is a cross-sectional view of the adjustable fastener connecting the rearward shaft to the forward shaft.
Figure 7A:
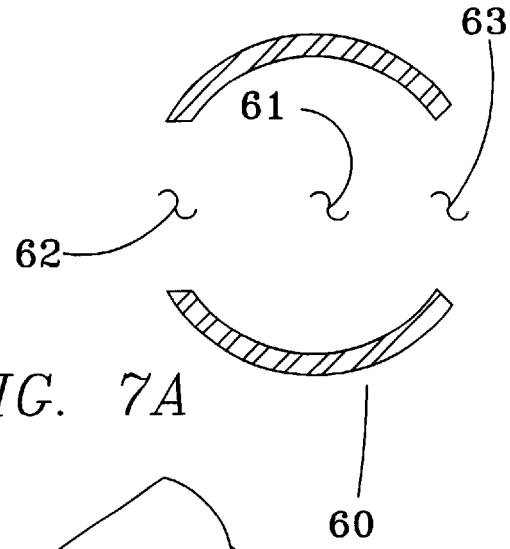
FIG. 7A is a view similar to that of FIG. 7, but having the rearward shaft removed, to better illustrate the forward and rearward holes defined in the handle.

A forward end 28 of the rearward shaft carries an adjustable fastener 29 which is attachable to either a similar adjustable fastener 41 carried by the forward shaft 40 or an integral dent repair tip 50. Referring particularly to FIGS. 6 and 8, it can be seen that the adjustable fastener 29 is very similar to the structure of the adjustable fastener 41 defined on the forward shaft 40, to which the fastener 29 attaches. A plurality of teeth 30 are arrayed radially about a centrally located threaded passage 31 through which a bolt 32 extends.

Figure 4:
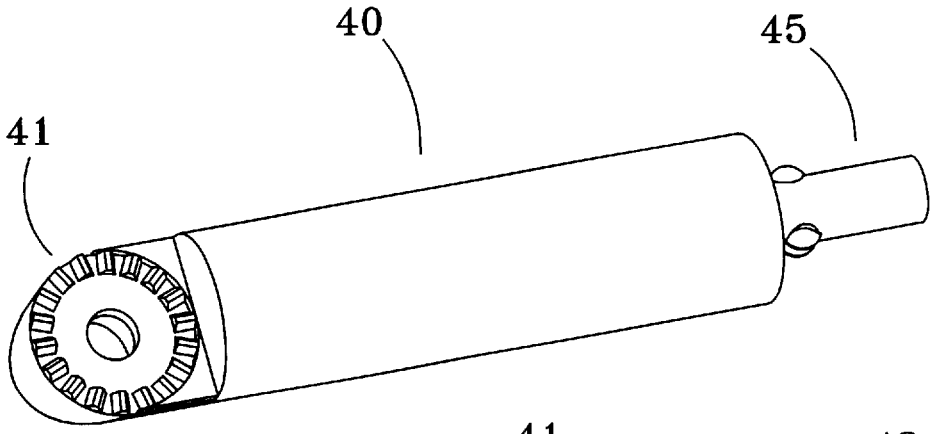
FIG. 4 is a perspective view of the forward shaft, particularly showing the adjustable fastener, which attaches to the forward end of the rearward shaft.
Figure 5:
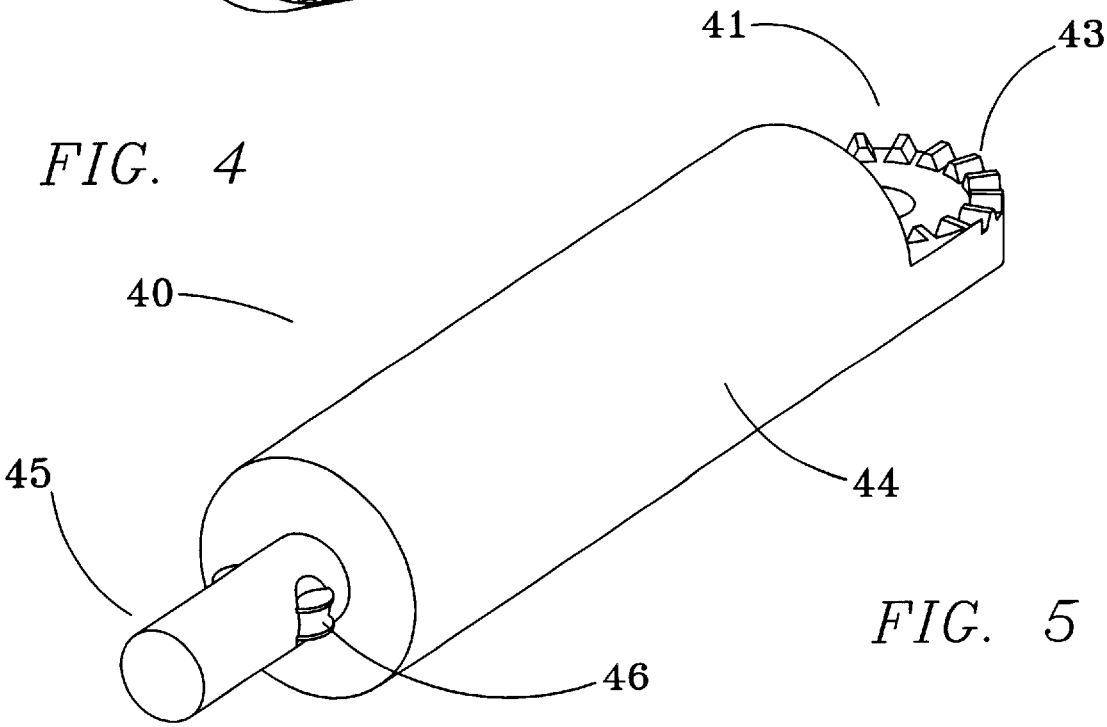
FIG. 5 is a perspective view of the forward shaft, particularly showing the tip fastener peg, which allows attachment of any of a plurality of tips seen in FIG. 2.

A forward shaft 40 may be pivoted to a desired angle with respect to the rearward shaft, and then secured in place. A preferred version of the forward shaft is seen in FIGS. 4 and 5. FIG. 6 illustrates a partial range of motion of a forward shaft and spherical tip. The angle that is desired will depend on the nature of the dent, the shape of the panel to be straightened and particularly, the nature of the access to the dent. In most cases, some experimentation will be needed to determine the best angle for use.

The forward shaft is typically ⅜" or ⅜" in diameter, and is typically the same diameter as the rearward shaft. The length of the forward shaft is typically 3", but could be made any desired length, depending on the application.

As seen in FIGS. 4 and 5, the forward shaft typically includes a cylindrical body 44 having an adjustable fastener 41 at the rearward end and a tip fastener peg 45 at the forward end. As seen particularly in FIGS. 4, 6 and 8, an adjustable fastener 41, carried by a rearward portion of the forward shaft, mates with the similar fastener 29 carried by the rearward shaft. A plurality of teeth 43 are sized to mate with the teeth 30 of the adjustable fastener 29 carried by the rearward shaft 20. A recess 42 allows the head of the bolt 32 to be recessed in a manner illustrated in FIG. 8.

The angle between the forward shaft 40 and the rearward shaft 20 is selected by loosening the bolt 32 sufficiently to disengage the teeth 30 of the adjustable fastener 29 and the teeth 43 of the adjustable fastener 41. Once loosened, the fasteners may be repositioned and the bolt re-tightened.

A tip fastener peg 45 is carried by a forward portion of the forward shaft, and allows attachment of any of a variety of tips 80. As seen particularly in FIGS. 5 and 9, a "swedging" protrusion 46 is formed by a swedging tool. The swedging protrusion engages the annular passage 90 defined about the generally cylindrical passage 89 defined in each tip 80.

An integral dent repair tip 50 may be installed on the adjustable fastener 29 of the rearward shaft 20 as an alternative to the forward shaft 40 and a tip 80. The integral dent repair tip provides functionality that is similar to that of the forward shaft 40, when combined with a tip 80. The integral dent repair tip is made of heat-treated stainless steel. As a result, the dent repair surface 51 of the integral tip is substantially harder than the tips 80 which are removably attachable to the forward shaft 40.

Figure 3:
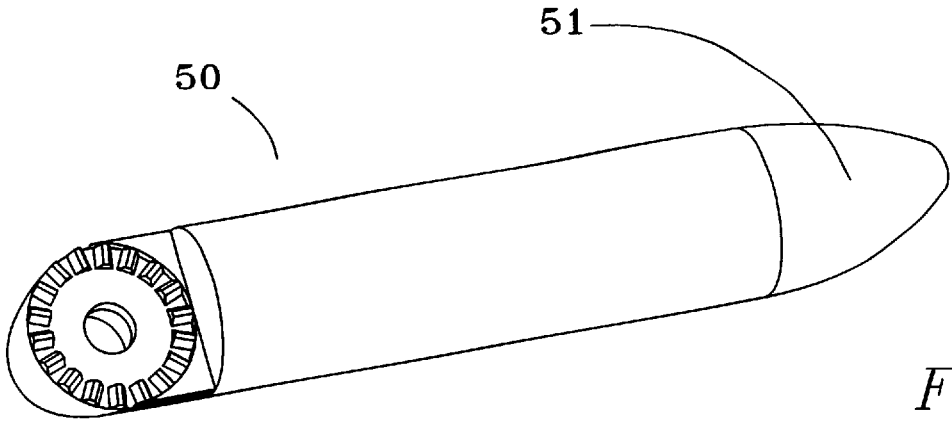
FIG. 3 is perspective view of a version of the integral dent repair tip.

As seen in FIG. 3, the construction of the integral dent repair tip is similar to the forward shaft; however, the tip fastener peg is replaced with the dent repair surface. The adjustable fastener 41 is typically identical, which allows the integral dent repair tip to be easily interchanged with the forward shaft.

As seen particularly in FIGS. 6 and 7, the tool body 11 contains a handle 60 carried by a rearward portion 23 of the rearward shaft 20. The handle allows the user to firmly grasp the auto body dent repair tool 10 during operation. In particular, the handle allows the user to push or pull in any direction, and to rotate in either direction. A preferred handle is constructed of a 5" segment of 1" stainless steel tube, having a cylindrical passage 61. Referring particularly to FIGS. 1 and 7, a forward hole 62 and a rearward hole 63 are defined in the center of the handle. The rear end 26 of the rearward portion 22 passes through the holes 62, 63. A forward weld 64 attaches the rear end 26 to the perimeter of the forward hole, while a rearward weld 65 attaches the rear end to the perimeter of the rearward hole.

Any of a plurality of tips 80 may be attached to the tip fastener peg 45 of the forward shaft 40. The tip attached at any given time is selected after reflection on the size, shape and nature of the dent and the nature of the access to the dent. In a preferred embodiment of the kit of parts the tips include: a cylinder with half-sphere end 81; a small, mid-sized and large cylinders with rounded end 82, 83, 84; a cylinder with conical end 85; and small, mid-sized and large spheres 86, 87, 88. Each tip defines a differently sized and shaped surface 91 for dent contact. As a result, each tip is advantageous in certain circumstances.

Each tip has a peg insertion passage 89 defined within it, sized for insertion of the tip fastener peg 45. An annular passage 90, adjacent to the peg insertion passage, is sized for acceptance of the swedging protrusion 46. Tips can be made of polyethylene or other material.

In use, a tool body 11 having the appropriate length and diameter is chosen. The length of the tool body required is typically determined by the location of the dent to be repaired relative to the point of access. In some cases, a compound shaft 21 will provide better access. In other applications, the simple shaft will provide better access. In other applications, such as a hood panel, access is not an issue.

The diameter of the tool body should be selected to provide the necessary strength. In most applications, either a ⅜" or ½" diameter tool body provides sufficient strength.

The angle between the forward portion 22 of the compound shaft 21 or the forward portion of a simple shaft 25 is adjusted with respect to the forward shaft 40 or integral dent repair tip 50. The bolt 32 is loosened and the teeth 30 and 43 are disengaged. The angle is adjusted, and the teeth are reengaged and the bolt tightened.

Where the integral dent repair tip 50 is used, a tip 80 is not needed. Where the forward shaft has been installed, a tip is selected. The correct tip 80 depends on the job to be done. The tip fastener peg 45 is inserted into the passage 89 until the swedging protrusion engages the passage 90 defined within the tip 80.

The previously described versions of the present invention have many advantages, including a primary advantage of providing a kit of parts comprising a novel auto body dent repair tool, wherein the kit of parts can be adapted and adjusted for use in repairing a wide variety of dents, in a wide variety of locations, in a wide variety of vehicles with differing option packages, configuration and equipment.

Another advantage of the present invention is to provide a kit of parts comprising a novel auto body dent repair tool that may be configured in many ways, and is therefore more efficient and cost effective than conventional dent repair tools.

A still further advantage of the present invention is to provide a kit of parts comprising a novel auto body dent repair tool, which provides a rearward compound shaft in combination with an adjustable forward shaft, and thereby results in greater flexibility and more convenient use.

Although the present invention has been described in considerable detail and with reference to certain preferred versions, other versions are possible. For example, while a considerable number of component dimensions have been given, they are illustrative only of the preferred embodiment, and some alteration could be resorted to, while still in keeping within the teachings of the invention. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An auto body dent repair tool, comprising:

(A) a tool body, comprising:

(a) a rearward shaft comprising a simple shaft having rear end and a forward end carrying an adjustable fastener;

(b) a forward shaft having an adjustable fastener, carried by a rearward portion of the forward shaft, mated with the adjustable fastener carried by the rearward shaft, and having a tip fastener peg carried by a forward portion of the forward shaft; and (c) a handle formed of a tube oriented generally perpendicularly to the rearward shaft, wherein the tube defines a forward hole and a rearward hole and wherein a rearward end of the rearward shaft passes through the forward hole, and wherein a forward weld attaches the rearward end of the rearward shaft to a perimeter of the forward hole and wherein a rearward weld attaches the rearward end of the rearward shaft to a perimeter of the rearward hole; and (B) a tip, attached to the tip fastener peg of the forward shaft.

2. An auto body dent repair tool, comprising:

(A) a tool body, comprising:

(a) a rearward shaft comprising a compound shaft comprising forward and rearward portions separated by a fixed joint, having a rear end and a forward end carrying an adjustable fastener;

(b) a forward shaft having an adjustable fastener, carried by a rearward portion of the forward shaft, mated with the adjustable fastener carried by the rearward shaft to form an articulating connection between the forward end of the rearward shaft and the rearward portion of the forward shaft, and having a tip fastener peg carried by a forward portion of the forward shaft; and (c) a handle formed of a tube oriented generally perpendicularly to the rearward shaft, wherein the tube defines a forward hole and a rearward hole and wherein a rearward end of the rearward shaft passes through the forward hole, and wherein a forward weld attaches the rearward end of the rearward shaft to a perimeter of the forward hole and wherein a rearward weld attaches the rearward end of the rearward shaft to a perimeter of the rearward hole; and (B) a tip, attached to the tip fastener peg of the forward shaft.

3. A kit of parts for auto body dent repair, comprising:

(A) a plurality of tool bodies, wherein each tool body comprises:

(a) a rearward shaft comprising a simple shaft having rear end and a forward end carrying an adjustable fastener;

(b) a forward shaft having an adjustable fastener, carried by a rearward portion of the forward shaft, mated with the adjustable fastener carried by the rearward shaft, and having a tip fastener peg carried by a forward portion of the forward shaft; and (c) a handle, carried by a rearward portion of the rearward shaft, defines a hole through which passes the rearward portion of the rearward shaft;

(B) a plurality of tool bodies, wherein each tool body comprises:

(a) a rearward shaft comprising a compound shaft comprising forward and rearward portions separated by a fixed joint, having a rear end and a forward end carrying an adjustable fastener;

(b) a forward shaft having an adjustable fastener, carried by a rearward portion of the forward shaft, mated with the adjustable fastener carried by the rearward shaft, and having a tip fastener peg carried by a forward portion of the forward shaft; and (c) a handle formed of a tube oriented generally perpendicularly to the rearward shaft, wherein the tube defines a forward hole and a rearward hole and wherein a rearward end of the rearward shaft passes through the forward hole, and wherein a forward weld attaches the rearward end of the rearward shaft to a perimeter of the forward hole and wherein a rearward weld attaches the rearward end of the rearward shaft to a perimeter of the rearward hole;

(C) a plurality of integral dent repair tips, wherein each integral dent repair tip may be installed on the adjustable fastener of the rearward shaft; and (D) a plurality of tips, wherein any of a plurality of tips may be attached in turn to the tip fastener peg of the forward shaft.

* * * * *